US012366419B2

(12) United States Patent
Wang et al.

(10) Patent No.: US 12,366,419 B2
(45) Date of Patent: Jul. 22, 2025

(54) THREE-DIMENSIONAL HEAT TRANSFER DEVICE

(71) Applicant: VAST GLORY ELECTRONICS & HARDWARE & PLASTIC(HUI ZHOU) LTD., Hui Zhou (CN)

(72) Inventors: Xue Mei Wang, Hui Zhou (CN); Zhijie Yang, Hui Zhou (CN)

(73) Assignee: VAST GLORY ELECTRONICS & HARDWARE & PLASTIC (HUI ZHOU) LTD., Hui Zhou (CN)

( * ) Notice: Subject to any disclaimer, the term of this patent is extended or adjusted under 35 U.S.C. 154(b) by 0 days.

(21) Appl. No.: 17/693,697

(22) Filed: Mar. 14, 2022

(65) Prior Publication Data

US 2023/0184491 A1 Jun. 15, 2023

(30) Foreign Application Priority Data

Dec. 15, 2021 (CN) ..... 202111538788.8

(51) Int. Cl.

| | |
|---|---|
| ***F28D 15/02*** | (2006.01) |
| ***F28D 9/00*** | (2006.01) |
| ***F28D 15/04*** | (2006.01) |
| ***F28D 21/00*** | (2006.01) |

(52) U.S. Cl.

CPC ..... *F28D 15/0233* (2013.01); *F28D 15/0266* (2013.01); *F28D 15/0275* (2013.01); *F28D 15/046* (2013.01); *F28D 9/0062* (2013.01); *F28D 2021/0029* (2013.01)

(58) Field of Classification Search

CPC ..... F28D 15/0233; F28D 15/0266; F28D 15/0275; F28D 15/046; H01L 23/427

See application file for complete search history.

(56) References Cited

U.S. PATENT DOCUMENTS

| | | | | |
|---|---|---|---|---|
| 3,834,454 | A * | 9/1974 | Gammel | F28D 15/0275 257/722 |
| 4,145,708 | A * | 3/1979 | Ferro | F28D 15/0266 257/722 |
| 5,647,430 | A * | 7/1997 | Tajima | F28F 3/025 257/E23.099 |
| 6,269,866 | B1 * | 8/2001 | Yamamoto | F28D 15/0233 174/15.2 |
| 6,738,257 | B1 * | 5/2004 | Lai | F28F 1/32 174/15.2 |
| 10,119,766 | B2 * | 11/2018 | Lin | F28D 15/046 |
| 10,126,069 | B2 * | 11/2018 | Sun | F28D 15/046 |
| 10,330,392 | B2 * | 6/2019 | Liu | F28F 1/325 |
| 10,663,231 | B2 * | 5/2020 | Tan | H01L 23/3736 |
| 2008/0130230 | A1 * | 6/2008 | Yu | H01L 23/467 257/E23.099 |

(Continued)

FOREIGN PATENT DOCUMENTS

| | | | | |
|---|---|---|---|---|
| CN | 106197104 | A | 12/2016 | |
| CN | 108151565 | A * | 6/2018 | F28D 15/046 |

*Primary Examiner* — Jianying C Atkisson
*Assistant Examiner* — For K Ling
(74) *Attorney, Agent, or Firm* — Merchant & Gould P.C.

(57) ABSTRACT

A three-dimensional heat transfer device includes a vapor chamber and a plurality of flatten heat pipes. The flatten heat pipes are disposed on the vapor chamber and arranged along an extension direction of a short side of the vapor chamber. Major axes of cross-sections of the flatten heat pipes are parallel to a long side of the vapor chamber.

8 Claims, 7 Drawing Sheets

(56) References Cited

U.S. PATENT DOCUMENTS

2010/0263834 A1* 10/2010 Hwang ..... F28D 15/0266
165/104.26
2017/0198980 A1* 7/2017 Lan ..... F28D 15/0233

* cited by examiner

THREE-DIMENSIONAL HEAT TRANSFER DEVICE

CROSS-REFERENCE TO RELATED APPLICATIONS

This non-provisional application claims priority under 35 U.S.C. § 119(a) on Patent Application No(s). 202111538788.8 filed in China on Dec. 15, 2021, the entire contents of which are hereby incorporated by reference.

TECHNICAL FIELD

The disclosure provides a heat transfer device, more particularly to a three-dimensional heat transfer device.

BACKGROUND

In order to increase the heat dissipation efficiency to a heat source, a conventional heat dissipation device adopts a thermal conductive plate and heat pipes to transfer heat, and uses a heat dissipation assembly (e.g., a fan and fins) to dissipate heat to outside environment.

The thermal conductive plate is in contact with the heat source. The heat pipes connect the thermal conductive plate with the heat dissipation assembly, and capillary structures inside the heat pipes are thermally coupled to a capillary structure inside the thermal conductive plate. By this configuration, when the thermal conductive plate absorbs heat generated from the heat source, the heat vaporizes a working fluid inside the thermal conductive plate, and the vaporized working fluid flows from ends of the heat pipes located close to the thermal conductive plate to the other ends thereof located close to the heat dissipation assembly. Then, the vaporized working fluid is condensed by the heat dissipation assembly so as to become the liquid working fluid, and the liquid working fluid flows back to the thermal conductive plate with the help of the capillary structures in the heat pipes and the thermal conductive plate. However, it is difficult to improve the heat dissipation efficiency of the conventional thermal conductive plate provided with the heat pipes, and thus how to solve this issue is one of the crucial topics in this field.

SUMMARY

The disclosure provides a three-dimensional heat transfer device which is capable of providing a sufficient heat dissipation efficiency.

One embodiment of the disclosure provides a three-dimensional heat transfer device. The three-dimensional heat transfer device includes a vapor chamber and a plurality of flatten heat pipes. The flatten heat pipes are disposed on the vapor chamber and arranged along an extension direction of a short side of the vapor chamber. Major axes of cross-sections of the flatten heat pipes are parallel to a long side of the vapor chamber.

According to the three-dimensional heat transfer device as discussed in the above embodiment, the flatten heat pipes are arranged along the extension direction of the short side of the vapor chamber, and the major axes of the cross-sections of the flatten heat pipes are parallel to the long side of the vapor chamber, such that when an airflow is towards the three-dimensional heat transfer device, a total windward area of the flatten heat pipes can be reduced as much as possible so as to reduce air resistance, thereby increasing the heat dissipation efficiency of the three-dimensional heat transfer device.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
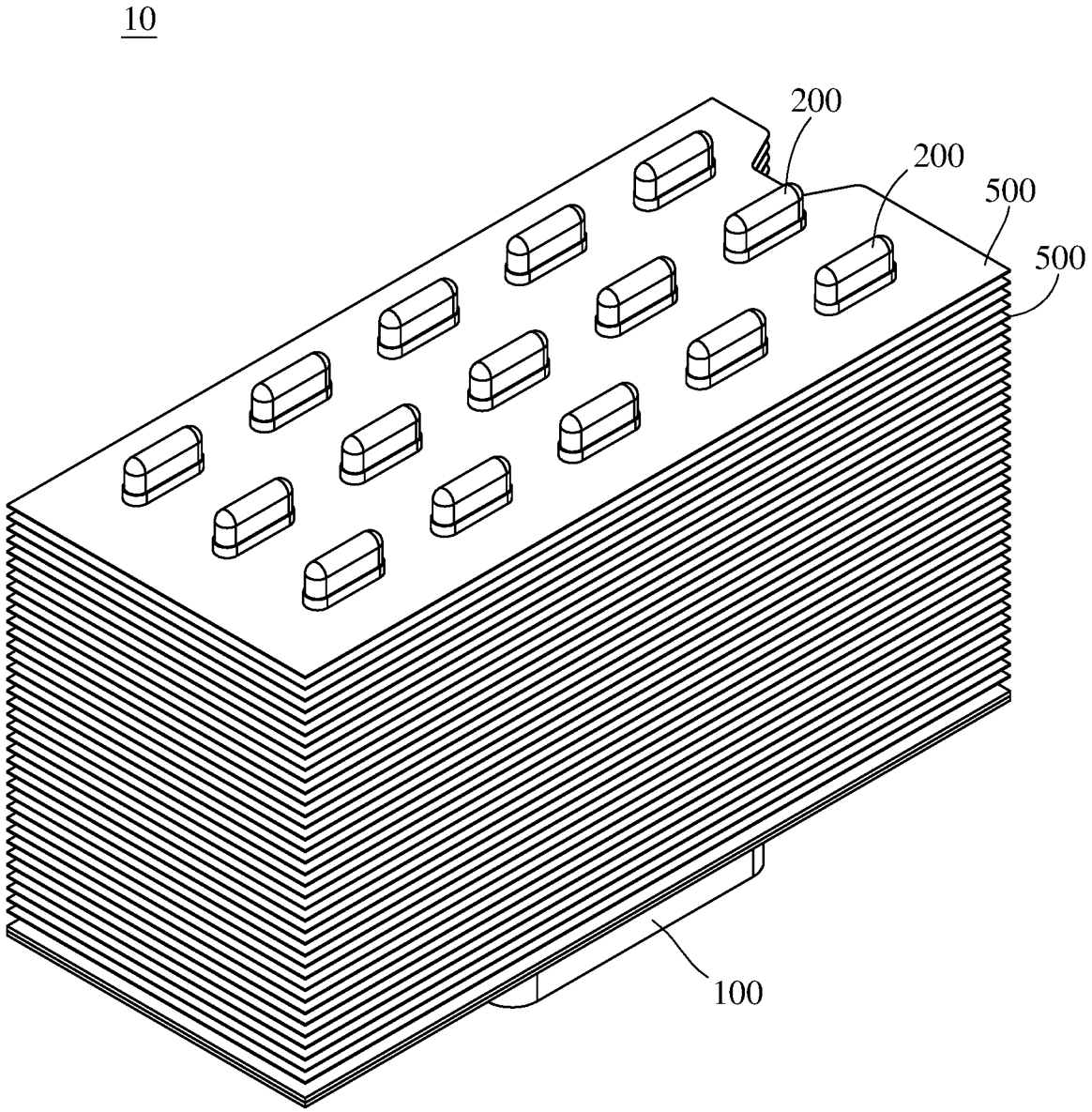
FIG. 1 is a perspective view of a three-dimensional heat transfer device according to a first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Figure 2:
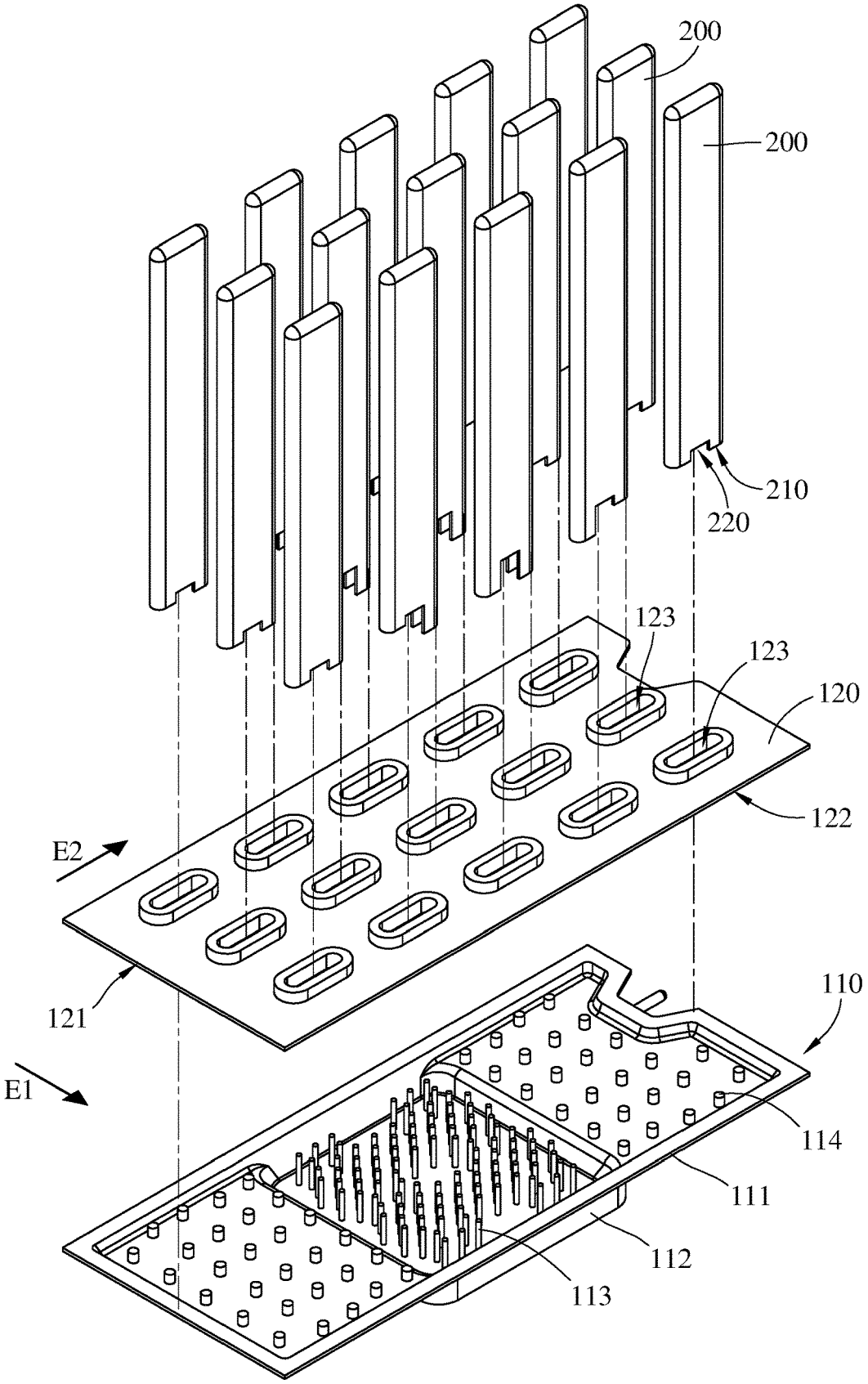
FIG. 2 is a partial exploded view of the three-dimensional heat transfer device in FIG. 1.

Refer to FIGS. 1 and 2, where FIG. 1 is a perspective view of a three-dimensional heat transfer device 10 according to a first embodiment of the disclosure, and FIG. 2 is a partial exploded view of the three-dimensional heat transfer device 10 in FIG. 1.

Figure 4:
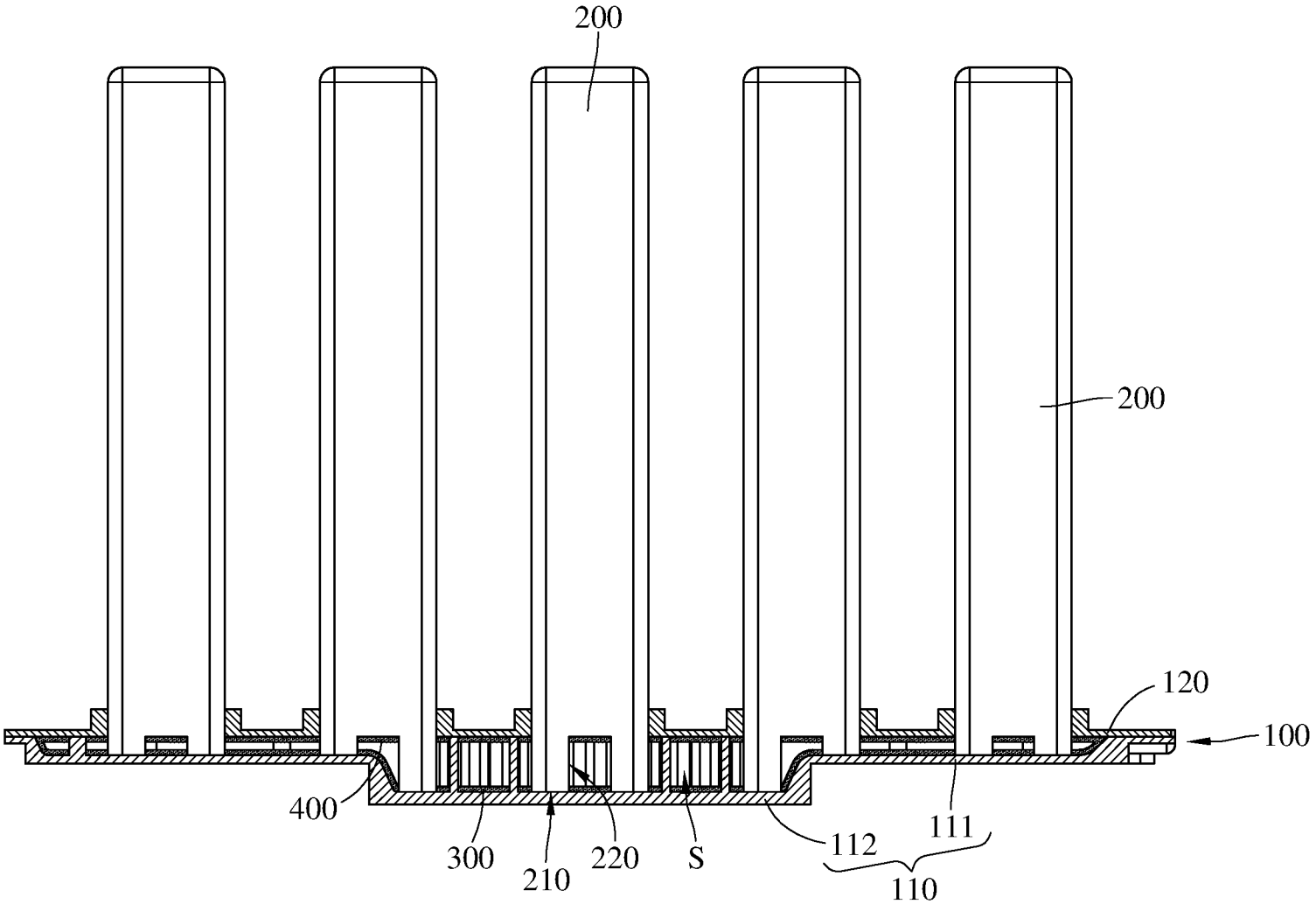
FIG. 4 is a partial cross-sectional view of the three-dimensional heat transfer device in FIG. 1.

In this embodiment, the three-dimensional heat transfer device 10 includes a vapor chamber 100, a plurality of flatten heat pipes 200, and a plurality of heat dissipation fins 500. The vapor chamber 100 includes a bottom plate 110 and a cover 120. The cover 120 is disposed on the bottom plate 110, and the bottom plate 110 and the cover 120 together surround a fluid chamber S (as shown in FIG. 4). The cover 120 has a plurality of through holes 123. The flatten heat pipes 200 are respectively disposed through the through holes 123 and connected to the bottom plate 110. The heat dissipation fins 500 are mounted on the flatten heat pipes 200.

In this embodiment, the bottom plate 110 includes a main portion 111 and a recessed portion 112. The recessed portion 112 is recessed from the main portion 111. Some of the flatten heat pipes 200 are connected to the main portion 111 of the bottom plate 110, and others of the flatten heat pipes 200 are connected to the recessed portion 112 of the bottom plate 110. In addition, the bottom plate 110 further includes a plurality of first supports 113 and a plurality of second supports 114. The first supports 113 are located in the fluid chamber S, and protrude from the recessed portion 112 and support the cover 120. A diameter of each of the second supports 114 is larger than a diameter of each of the first supports 113. The second supports 114 are located in the fluid chamber S, and protrude from the main portion 111 and support the cover 120. Therefore, the first supports 113 and the second supports 114 can increase the structural strength of the vapor chamber 100.

The recessed portion 112 of the bottom plate 110 is configured to be in thermal contact with a heat source, such as, a CPU or GPU, for absorbing heat generated therefrom. After heat is absorbed by the bottom plate 110, the heat will be conducted to the flatten heat pipes 200, and then the flatten heat pipes 200 and the heat dissipation fins 500 disposed on the flatten heat pipes 200 can dissipate the heat thereon to outside environment.

Note that the quantity of the heat dissipation fins 500 are not restricted in the disclosure and may be modified to be one or may be omitted in some other embodiments.

Figure 3:
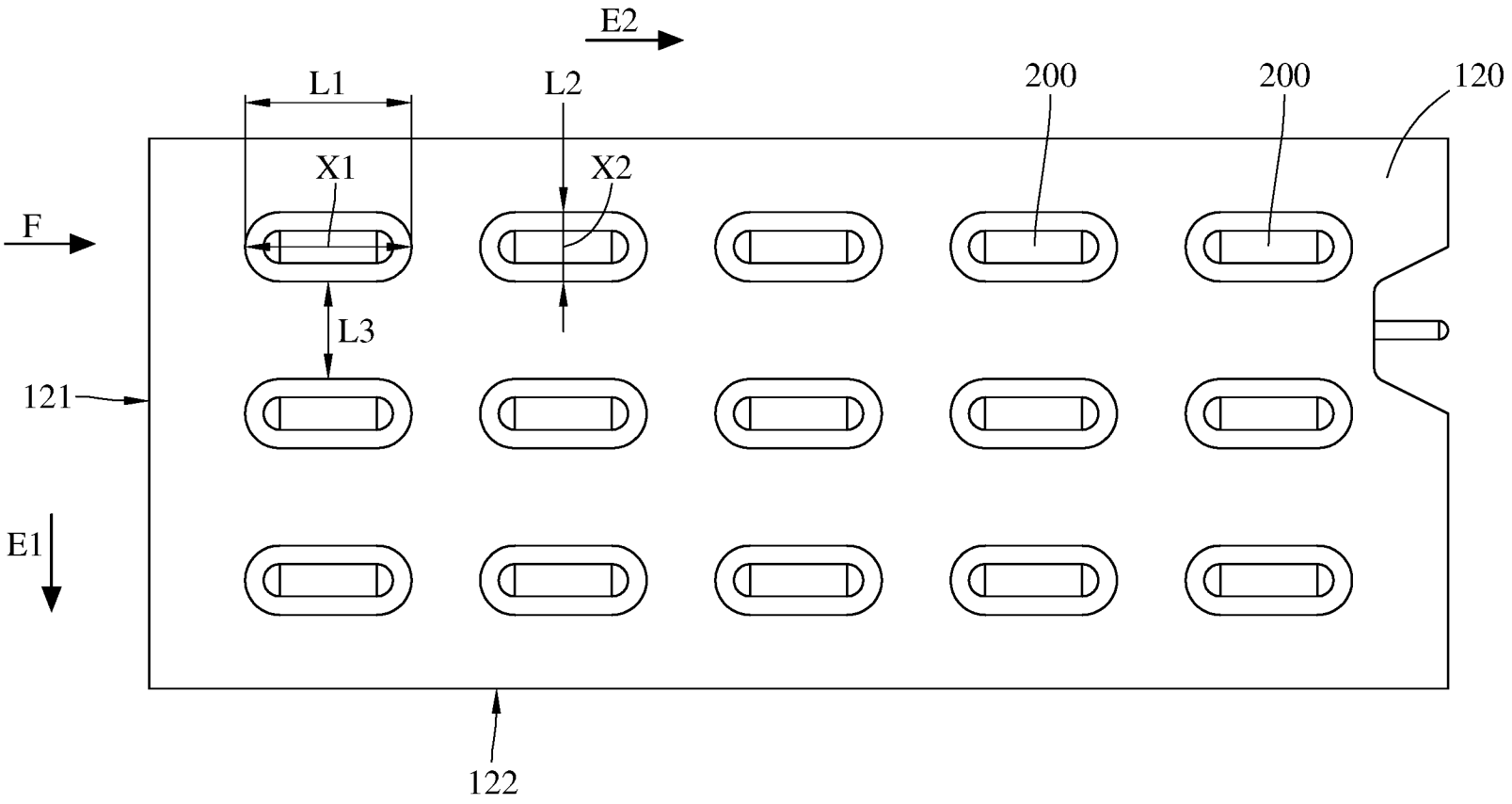
FIG. 3 is a partial top view of the three-dimensional heat transfer device in FIG. 1.

Refer to FIGS. 2 and 3, where FIG. 3 is a partial top view of the three-dimensional heat transfer device 10 in FIG. 1.

The flatten heat pipes 200 are arranged along an extension direction E1 of a short side 121 of the vapor chamber 100. Each of the flatten heat pipes 200 has a cross-section in an oval or elliptical shape, where the cross-section has a major axis X1 and a minor axis X2, and a length L1 of the major axis X1 is larger than a length L2 of the minor axis X2. The major axes X1 of the cross-sections of the flatten heat pipes 200 are parallel to a long side 122 of the vapor chamber 100. In the extension direction E1 of the short side 121 of the vapor chamber 100, a distance L3 between two of the flatten heat pipes 200 which are located adjacent to each other is larger than the length L2 of the minor axis X2 of the cross-section of the flatten heat pipe 200; that is, the distance L3 between two of the flatten heat pipes 200 which are located adjacent to each other is larger than a thickness of the flatten heat pipe 200.

Since the major axes X1 of the flatten heat pipes 200 are parallel to the long side 122 of the vapor chamber 100, when an airflow is towards the three-dimensional heat transfer device 10 along a direction F substantially parallel to the long side 122 of the vapor chamber 100, a total windward area of the flatten heat pipes 200 can be reduced as much as possible so as to reduce the air resistance, thereby increasing the heat dissipation efficiency of the three-dimensional heat transfer device 10. In addition, since the flatten heat pipes 200 are arranged along the extension direction E1 of the short side 121 of the vapor chamber 100, the quantity of the flatten heat pipes 200 in the extension direction E1 can be reduced as much as possible, such that the total windward area can also be reduced so as to reduce the air resistance, thereby further increasing the heat dissipation efficiency of the three-dimensional heat transfer device 10.

In this embodiment, the flatten heat pipes 200 are arranged in a 3x5 array; that is, the flatten heat pipes 200 are arranged not only along the extension direction E1 of the short side 121 of the vapor chamber 100 but also an extension direction E2 of the long side 122 of the vapor chamber 100. In this embodiment, there are plural flatten heat pipes 200 arranged along the extension direction E2 of the long side 122 of the vapor chamber 100 in each row of the array, but the present disclosure is not limited thereto; in some other embodiments, there may be only one heat pipe arranged along the extension direction of the long side of the vapor chamber in each row of the array; that is, the flatten heat pipes arranged along the extension direction of the long side of the vapor chamber in each row of the array may be modified to one flatten heat pipe.

Figure 5:
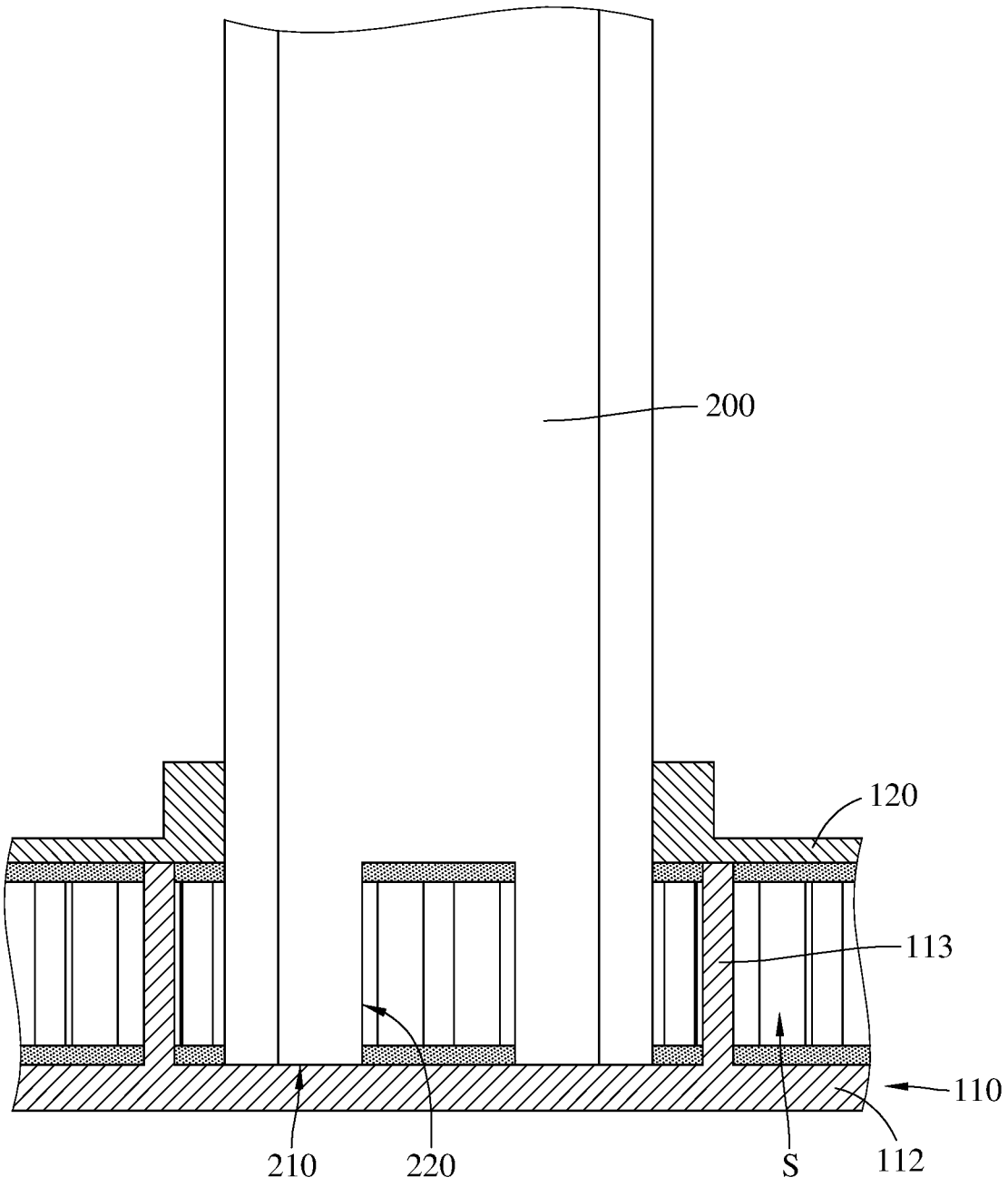
FIG. 5 is a partial and enlarged cross-sectional view of the three-dimensional heat transfer device in FIG. 4.

Refer to FIGS. 2 to 5, where FIG. 4 is a partial cross-sectional view of the three-dimensional heat transfer device 10 in FIG. 1, and FIG. 5 is a partial and enlarged cross-sectional view of the three-dimensional heat transfer device 10 in FIG. 4.

In this embodiment, the three-dimensional heat transfer device 10 may further include a first capillary structure 300 and a second capillary structure 400. The first capillary structure 300 is located in the fluid chamber S and stacked on the bottom plate 110. The flatten heat pipes 200 are in thermal contact with the first capillary structure 300 and connected to the bottom plate 110 via the first capillary structure 300. The second capillary structure 400 is located in the fluid chamber S and stacked on the cover 120.

In this embodiment, the first capillary structure 300 and the second capillary structure 400 are, for example, sintered powder, but the present disclosure is not limited thereto; in some other embodiments, the first capillary structure and the second capillary structure may be a material selected from a group consisting of metal net, sintered powder and sintered ceramics. For example, the first capillary structure and the second capillary structure may be a composite of sintered powder and micro structure, such as a groove.

Note that the first capillary structure 300 and the second capillary structure 400 of the three-dimensional heat transfer device 10 are optional in the disclosure; in some other embodiments, the three-dimensional heat transfer device may omit the first capillary structure and/or the second capillary structure.

In this embodiment, each of the flatten heat pipe 200 has an opening end 210 and a notch 220 located at the opening end 210. An inner space of each of the flatten heat pipes 200 is in fluid communication with the fluid chamber S via the notch 220. Therefore, a working fluid inside the fluid chamber S of the vapor chamber 100 can flow into the flatten heat pipes 200 via the notches 220, such that heat absorbed by the vapor chamber 100 can be rapidly transferred to the flatten heat pipes 200.

In this embodiment, the flatten heat pipes 200 are in contact with the first capillary structure 300 or connected to the first capillary structure 300 via a sintering or another suitable process so as to increase the heat dissipation efficiency of the three-dimensional heat transfer device 10.

Figure 6:
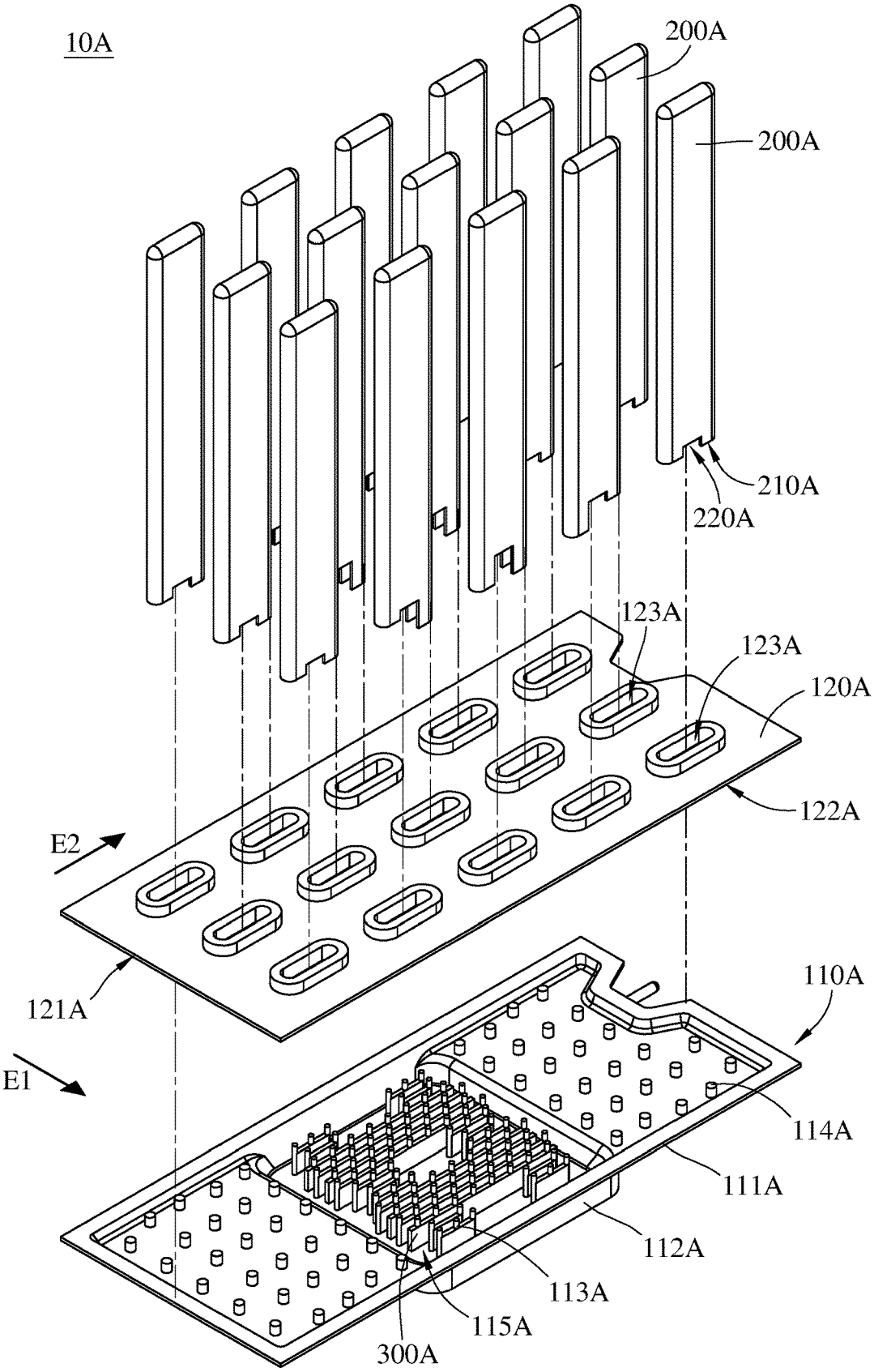
FIG. 6 is an exploded view of a three-dimensional heat transfer device according to a second embodiment of the disclosure.
Figure 7:
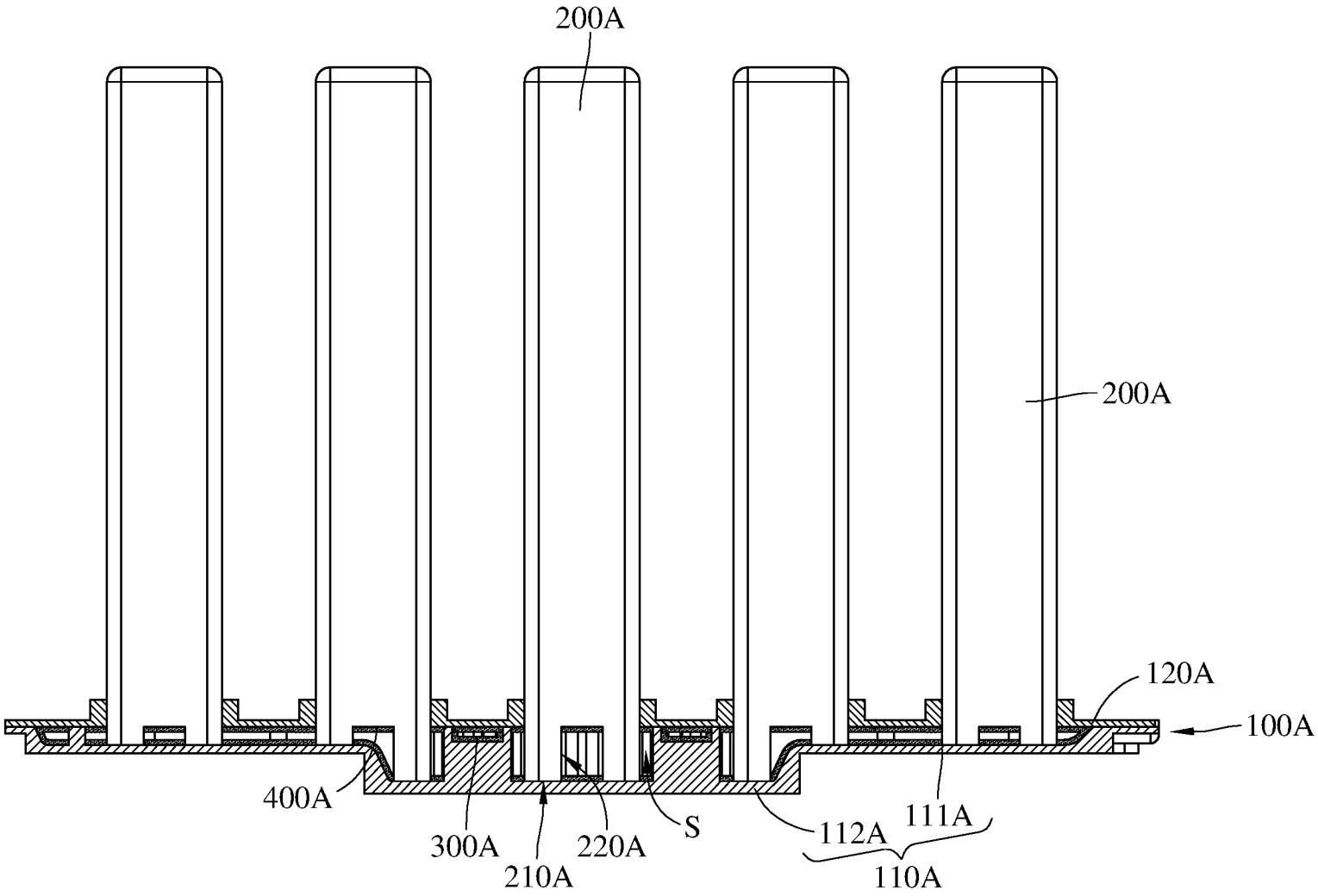
FIG. 7 is a cross-sectional view of the three-dimensional heat transfer device in FIG. 6.

Refer to FIGS. 6 and 7, where FIG. 6 is an exploded view of a three-dimensional heat transfer device 10A according to a second embodiment of the disclosure, and FIG. 7 is a cross-sectional view of the three-dimensional heat transfer device 10A in FIG. 6.

In this embodiment, the three-dimensional heat transfer device 10A includes a vapor chamber 100A and a plurality of flatten heat pipes 200A. In addition, similar to the three-dimensional heat transfer device 10 of the previous embodiment, the three-dimensional heat transfer device 10A of this embodiment may include the heat dissipation fins. The heat dissipation fins of the three-dimensional heat transfer device 10A are substantially the same as that of the three-dimensional heat transfer device 10, and thus the following paragraphs will not repeatedly introduce the heat dissipation fins, and the figures omit the heat dissipation fins.

The vapor chamber 100A includes a bottom plate 110A and a cover 120A. The cover 120A is disposed on the bottom plate 110A, and the bottom plate 110A and the cover 120A together surround a fluid chamber S. The cover 120A has a plurality of through holes 123A. The flatten heat pipes 200A are respectively disposed through the through holes 123A and connected to the bottom plate 110A.

In this embodiment, the bottom plate 110A includes a main portion 111A and a recessed portion 112A. The recessed portion 112A is recessed from the main portion 111A. Some of the flatten heat pipes 200A are connected to the main portion 111A of the bottom plate 110A, and others of the flatten heat pipes 200A are connected to the recessed portion 112A of the bottom plate 110A. In addition, the bottom plate 110A further includes a plurality of first supports 113A and a plurality of second supports 114A. The first supports 113A are located in the fluid chamber S, and protrude from the recessed portion 112A and support the cover 120A. A diameter of each of the second supports 114A is larger than a diameter of each of the first supports 113A. The second supports 114A are located in the fluid chamber S, and protrude from the main portion 111A and support the cover 120A. Therefore, the first supports 113A and the second supports 114A can increase the structural strength of the vapor chamber 100A.

The recessed portion 112A of the bottom plate 110A is configured to be in thermal contact with a heat source, such as, a CPU or GPU, for absorbing heat generated therefrom. After heat is absorbed by the bottom plate 110A, the heat will be conducted to the flatten heat pipes 200A, and then the flatten heat pipes 200A can dissipate the heat thereon to outside environment.

The three-dimensional heat transfer device 10A may further include a plurality of thermal conductive structures 115A. The thermal conductive structures 115A are, for example, made of metal. The thermal conductive structures 115A are, for example, connected to at least some of the first supports 113A. The thermal conductive structures 115A are parallel to each other and protrude from the recessed portion 112A of the bottom plate 110A; that is, the thermal conductive structures 115A are in thermal contact with the bottom plate 110A.

In this embodiment, the thermal conductive structures 115A are, for example, rectangular plates with different lengths, but the present disclosure is not limited thereto; in some other embodiments, the thermal conductive structures may be plates with another shape as long as a desired vapor pressure drop can be provided in the fluid chamber S, and a high liquid pressure drop caused by the capillary action provide by the capillary structure of sintered powder can be reduced.

In this embodiment, the first supports 113A, the second supports 114A, and the thermal conductive structures 115A may be integrally formed on the bottom plate 110A via stamping process, computer numerical control process or other processes, but the disclosure is not limited thereto; in some other embodiments, the supports and the thermal conductive structure may be coupled to the bottom plate via welding process, diffusion bonding process, thermal pressing process, soldering process, brazing process, or adhering processing.

The flatten heat pipes 200A are arranged along an extension direction E1 of a short side 121A of the vapor chamber 100A. Each of the flatten heat pipes 200A has a cross-section in an oval or elliptical shape, where the cross-section has a major axis and a minor axis, and a length of the major axis is larger than a length of the minor axis. The major axes of the cross-sections of the flatten heat pipes 200A are parallel to a long side 122A of the vapor chamber 100A. In the extension direction E1 of the short side 121A of the vapor chamber 100A, a distance between two of the flatten heat pipes 200A which are located adjacent to each other is larger than the length of the minor axis of the flatten heat pipe 200A; that is, the distance between two of the flatten heat pipes 200A which are located adjacent to each other is larger than a thickness of the flatten heat pipe 200A.

The three-dimensional heat transfer device 10A may further include a first capillary structure 300A and a second capillary structure 400A. The first capillary structure 300A is located in the fluid chamber S and stacked on the bottom plate 110A and the thermal conductive structures 115A. The flatten heat pipes 200A are in thermal contact with the first capillary structure 300A and connected to the bottom plate 110A via the first capillary structure 300A. The second capillary structure 400A is located in the fluid chamber S and stacked on the cover 120A.

In this embodiment, the first capillary structure 300A and the second capillary structure 400A are, for example, sintered powder, but the present disclosure is not limited thereto; in some other embodiments, the first capillary structure and the second capillary structure may be a material selected from a group consisting of metal net, sintered powder and sintered ceramics. For example, the first capillary structure and the second capillary structure may be a composite of sintered powder and micro structure, such as a groove.

Note that the first capillary structure 300A and the second capillary structure 400A of the three-dimensional heat transfer device 10A are optional in the disclosure; in some other embodiments, the three-dimensional heat transfer device may omit the first capillary structure and/or the second capillary structure.

In this embodiment, each of the flatten heat pipe 200A has an opening end 210A and a notch 220A located at the opening end 210A. An inner space of each of the flatten heat pipes 200A is in fluid communication with the fluid chamber S via the notch 220A. Therefore, a working fluid inside the fluid chamber S of the vapor chamber 100A can flow into the flatten heat pipes 200A via the notches 220A, such that heat absorbed by the vapor chamber 100A can be rapidly transferred to the flatten heat pipes 200A.

In this embodiment, the flatten heat pipes 200A are in contact with the first capillary structure 300A or connected to the first capillary structure 300A via a sintering or another suitable process so as to increase the heat dissipation efficiency of the three-dimensional heat transfer device 10A.

In this embodiment, the distance between two of the flatten heat pipes 200 which are located adjacent to each other is larger than the thickness of the flatten heat pipe 200A, but the disclosure is not limited thereto; in some other embodiments, the distance between two of the flatten heat pipes which are located adjacent to each other may be smaller than or equal to the thickness of the flatten heat pipe. In such a case, there may be more flatten heat pipes, and those flatten heat pipes can be arranged in high density so as to increase the heat dissipation efficiency of the three-dimensional heat transfer device.

According to the three-dimensional heat transfer devices as discussed in the above embodiments, the flatten heat pipes are arranged along the extension direction of the short side of the vapor chamber, and the major axes of the cross-sections of the flatten heat pipes are parallel to the long side of the vapor chamber, such that when an airflow is towards the three-dimensional heat transfer device, a total windward area of the flatten heat pipes can be reduced as much as possible so as to reduce air resistance, thereby increasing the heat dissipation efficiency of the three-dimensional heat transfer device.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A three-dimensional heat transfer device, comprising:

a vapor chamber including a bottom plate and a cover, the bottom plate comprising a main portion, a recessed portion, and a plurality of first supports, the recessed portion is recessed from the main portion, the plurality of first supports is coupled to the recessed portion and protrudes therefrom, the cover is disposed on the bottom plate and the plurality of first supports, the bottom plate and the cover together surround a fluid chamber, the cover has a plurality of through holes;

a plurality of flatten heat pipes, respectively disposed through the plurality of through holes and on the main portion and recessed portion and arranged in an array along an extension direction of a short side of the vapor chamber; and a plurality of thermal conductive structures, the plurality of thermal conductive structures is coupled to the recessed portion and protrudes therefrom, the plurality of thermal conductive structures comprises a rectangular shape, whereby the plurality of thermal conductive structures is parallel to a long side of the vapor chamber;

wherein, each plurality of thermal conductive structures is coupled to at least two of the plurality of first supports; and wherein, major axes of cross-sections of the plurality of flatten heat pipes are parallel to a long side of the vapor chamber.

2. The three-dimensional heat transfer device according to claim 1, wherein in the extension direction of the short side of the vapor chamber, a distance between two of the plurality of flatten heat pipes which are located adjacent to each other is larger than a thickness of each of the plurality of flatten heat pipes.

3. The three-dimensional heat transfer device according to claim 1, further comprising a first capillary structure, wherein the first capillary structure is located in the fluid chamber and stacked on the bottom plate, the plurality of flatten heat pipes are in thermal contact with the first capillary structure.

4. The three-dimensional heat transfer device according to claim 3, further comprising a second capillary structure, wherein the second capillary structure is located in the fluid chamber and stacked on the cover.

5. The three-dimensional heat transfer device according to claim 1, wherein each of the plurality of flatten heat pipes has an opening end and a notch located at the opening end, and the notch is configured to enable a flow of working fluid inside of the fluid chamber to transport into and out of an inner space of each plurality of flatten heat pipes via the notch, whereby the flow is perpendicular to the long side of the vapor chamber.

6. The three-dimensional heat transfer device according to claim 1, wherein the bottom plate further comprises a plurality of second supports, the plurality of second supports is coupled to the main portion and protrudes therefrom, and a diameter of each of the plurality of second supports is larger than a diameter of each of the plurality of first supports.

7. The three-dimensional heat transfer device according to claim 1, further comprising a heat dissipation fin, wherein the heat dissipation fin is mounted on the plurality of flatten heat pipes.

8. The three-dimensional heat transfer device according to claim 1, wherein the recessed portion is recessed from the main portion such that one part of the main portion is disposed on one perimeter side of the recessed portion and an other part of the main portion is disposed on an other perimeter side of the recessed portion opposite the one part of the main portion.

* * * * *